US011638679B2

(12) United States Patent
Schneider

(10) Patent No.: US 11,638,679 B2
(45) Date of Patent: May 2, 2023

(54) COMBINED TOY AND PACIFIER ASSEMBLY AND PACIFIER ATTACHMENT DEVICE FOR USE THEREIN

(71) Applicant: Trebco, LLC, Orange, CT (US)

(72) Inventor: Carla J. Schneider, Orange, CT (US)

(73) Assignee: Trebco LLC, Orange, CT (US)

( * ) Notice: Subject to any disclaimer, the term of this patent is extended or adjusted under 35 U.S.C. 154(b) by 89 days.

(21) Appl. No.: 15/748,324

(22) PCT Filed: Aug. 18, 2016

(86) PCT No.: PCT/US2016/047497

§ 371 (c)(1),
(2) Date: Jan. 29, 2018

(87) PCT Pub. No.: WO2017/031281

PCT Pub. Date: Feb. 23, 2017

(65) Prior Publication Data

US 2018/0214350 A1 Aug. 2, 2018

Related U.S. Application Data

(60) Provisional application No. 62/207,063, filed on Aug. 19, 2015.

(51) Int. Cl.
*A61J 17/00* (2006.01)
*A63H 3/00* (2006.01)

(52) U.S. Cl.
CPC ..... *A61J 17/1111* (2020.05); *A63H 3/003* (2013.01)

(58) Field of Classification Search
CPC ..... A61J 17/008; A61J 17/001; A61J 17/007; A61J 17/02; A61J 17/1111; A61J 17/1115;

(Continued)

(56) References Cited

U.S. PATENT DOCUMENTS

D310,716 S 9/1990 Trask
4,972,980 A * 11/1990 Parsons ..... A61J 17/00 224/194

(Continued)

FOREIGN PATENT DOCUMENTS

DE 20318101 U1 5/2004
GB 2452542 A 11/2009

OTHER PUBLICATIONS

The above US patent #1 and US publications #1-2 were cited in the International Search Report dated Dec. 8, 2016 of International Application No. PCT/US2016/047497, a copy of which is enclosed.

(Continued)

*Primary Examiner* — Diane D Yabut
*Assistant Examiner* — Christina C Lauer
(74) *Attorney, Agent, or Firm* — Cowan, Liebowitz & Latman, P.C.

(57) ABSTRACT

A pacifier attachment device for releasably attaching a pacifier to a toy, the pacifier attachment device comprising: an integrally-formed substrate formed from a flexible and elastic polymer material, wherein the integrally formed substrate includes a strap having a first strap portion and a second strap portion, and a coupling mechanism for releasably coupling the first strap portion with the second strap portion, said coupling mechanism being integrally formed with the strap.

24 Claims, 7 Drawing Sheets

(58) Field of Classification Search
CPC ..... A63H 3/003; A44B 17/0029; A44B 17/0023; A44B 17/0076
See application file for complete search history.

(56) References Cited

U.S. PATENT DOCUMENTS

| | | | | |
|---|---|---|---|---|
| 4,985,968 | A | 1/1991 | Hooper | |
| 6,442,759 | B1 | 9/2002 | Straham, Jr. et al. | |
| 6,666,740 | B1 | 12/2003 | Schneider | |
| 9,320,975 | B2 | 4/2016 | McClintock et al. | |
| 2006/0185129 | A1* | 8/2006 | Dubrawski | A61J 17/007 24/3.1 |
| 2008/0134432 | A1 | 6/2008 | Brandon | |
| 2009/0081921 | A1 | 3/2009 | Urueta | |
| 2010/0062677 | A1 | 3/2010 | Savoni et al. | |
| 2010/0304636 | A1* | 12/2010 | Seiz | A63H 3/003 446/72 |
| 2010/0317252 | A1 | 12/2010 | Raimondi | |
| 2014/0005722 | A1* | 1/2014 | Whelan | A61J 17/111 606/234 |
| 2014/0068859 | A1 | 3/2014 | Alegria | |
| 2014/0220852 | A1* | 8/2014 | McClintock | A63H 3/003 446/73 |
| 2015/0074949 | A1* | 3/2015 | Tsai | A44B 15/00 24/3.12 |
| 2016/0157591 | A1* | 6/2016 | Gadams | A45F 5/02 24/3.13 |
| 2016/0199264 | A1 | 7/2016 | McClintock et al. | |

OTHER PUBLICATIONS http://www.toysrus.com/buy/pacifier-holders-clips/bright-start-cozy-coos-deluxe-girafee-40020-30499886, published at least from Apr. 3, 2014, printed on Aug. 20, 2018.

http://www.kidshopechest.com/WubbaNubs/plush-animal-pacifiers.aspx, published at least from Apr. 3, 2014, printed on Apr. 3, 2018.

The above US Publication #7 and Foreign Publication # 2 were cited in the International Examination Report dated Apr. 3, 2018 of International Application No. GB1801426.6, a copy of which is enclosed.

* cited by examiner

COMBINED TOY AND PACIFIER ASSEMBLY AND PACIFIER ATTACHMENT DEVICE FOR USE THEREIN

FIELD OF INVENTION

The present application relates to a combined toy and pacifier assembly and a pacifier attachment device for use therein and, in particular, to a pacifier attachment device that universally couples a toy to a pacifier.

BACKGROUND OF THE INVENTION

Pacifiers are commonly used for small children. Due to the small size of most pacifiers, it is difficult for a child to locate the pacifier in his or her playpen or crib. Moreover, conventional pacifiers can easily fall through the slats in the child's crib or playpen. In order to reduce the risk of the pacifier falling through the slats of the crib or playpen and to enable a child to easily locate the pacifier in his or her crib or playpen, U.S. Pat. No. 6,666,740 describes a pacifier is securely attached to a stuffed toy which may be in the form of an animal or other geometric shape.

SUMMARY OF THE INVENTION

The present invention provides an improved combination of a pacifier with a stuffed toy and specifically, the attachment device for attaching the pacifier to the stuffed toy.

It is an objective of the present invention to provide a pacifier attachment device that universally couples a toy to a pacifier.

It is an objective of the present invention to provide a pacifier attachment device that removably couples a toy to a pacifier such that the pacifier may be easily replaced, or the toy may be washed without the pacifier attached, or the pacifier may be washed without also washing the toy.

It is an objective of the present invention to provide a combined toy and pacifier assembly that increases a child's enjoyment and entertainment of using a pacifier by coupling a toy, such as, a stuffed-animal or a stuffed geometric shape, to the pacifier.

The above and other objectives of the present invention are achieved by a pacifier attachment device comprising: a pacifier attachment device for releasably attaching a pacifier to a toy, the pacifier attachment device comprising an integrally-formed substrate formed from a flexible and elastic polymer material, wherein the integrally formed substrate includes a strap having a first strap portion and a second strap portion, and a coupling mechanism for releasably coupling the first strap portion with the second strap portion, said coupling mechanism being integrally formed with the strap. The strap includes a hinge portion between the first and second strap portions. In some embodiments, the hinge portion is a living hinge and wherein the hinge portion has a first thickness and the first and second strap portions have a second thickness greater than the first thickness. In other embodiments, the hinge portion has the same thickness as the first and second strap portions.

In certain embodiments, the coupling mechanism comprises a post member extending from a surface of the first strap portion, and a through opening provided in the second strap portion, the post member includes a locking end portion. The locking end portion has a greater span than the remainder of the post member and a greater span than a size of the through opening, and the post member is adapted to be inserted into the through opening so as to releasably retain the second strap portion between the first strap portion and the locking end portion of the post member. In certain embodiments, the post member and the through opening are disposed on their respective first and second strap portions at substantially equal distances from the hinge portion.

In certain embodiments, one of the first and second strap portions has a greater length than the other of the first and second strap portions, and the one of the first and second strap portions includes first and second retaining tabs extending from its opposing side edges and provided adjacent a free end of the one of the first and second strap portions. In such embodiments, the first and second retaining tabs are adapted to be inserted into a toy and to be retained within the toy when the pacifier attachment device is securely coupled with the toy. In some embodiments, each of the first and second retaining tabs has a T shape.

In some embodiments, wherein the flexible and elastic polymer material includes one or more of silicone, plastic, resin and rubber. In addition, the locking end portion is dome shaped.

A toy assembly adapted to be releasably coupled to a pacifier is also described. The toy assembly includes a three-dimensional plush toy, and the above-described pacifier attachment device securely coupled with the plush toy. The plush toy may have a three-dimensional animal shape including at least a body and a head extending from the body in a longitudinal direction, and the pacifier attachment device is securely coupled to the head of the plush toy and extends from the head of the plush toy substantially in the longitudinal direction.

Moreover, a combined toy and pacifier assembly is described. The combined toy and pacifier comprises a toy, a pacifier comprising a connector with a through aperture, a pacifier base and a pacifier nipple, wherein the connector is coupled to a first surface of the pacifier base and the pacifier nipple extends from a second surface of the pacifier base opposing the first surface, and the pacifier attachment device securely coupled with the toy. The toy is releasably coupled with the pacifier using the pacifier attachment device by passing the strap of the pacifier attachment device through the aperture in the connector of the pacifier and releasably coupling the first portion of the strap with the second portion of the strap.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
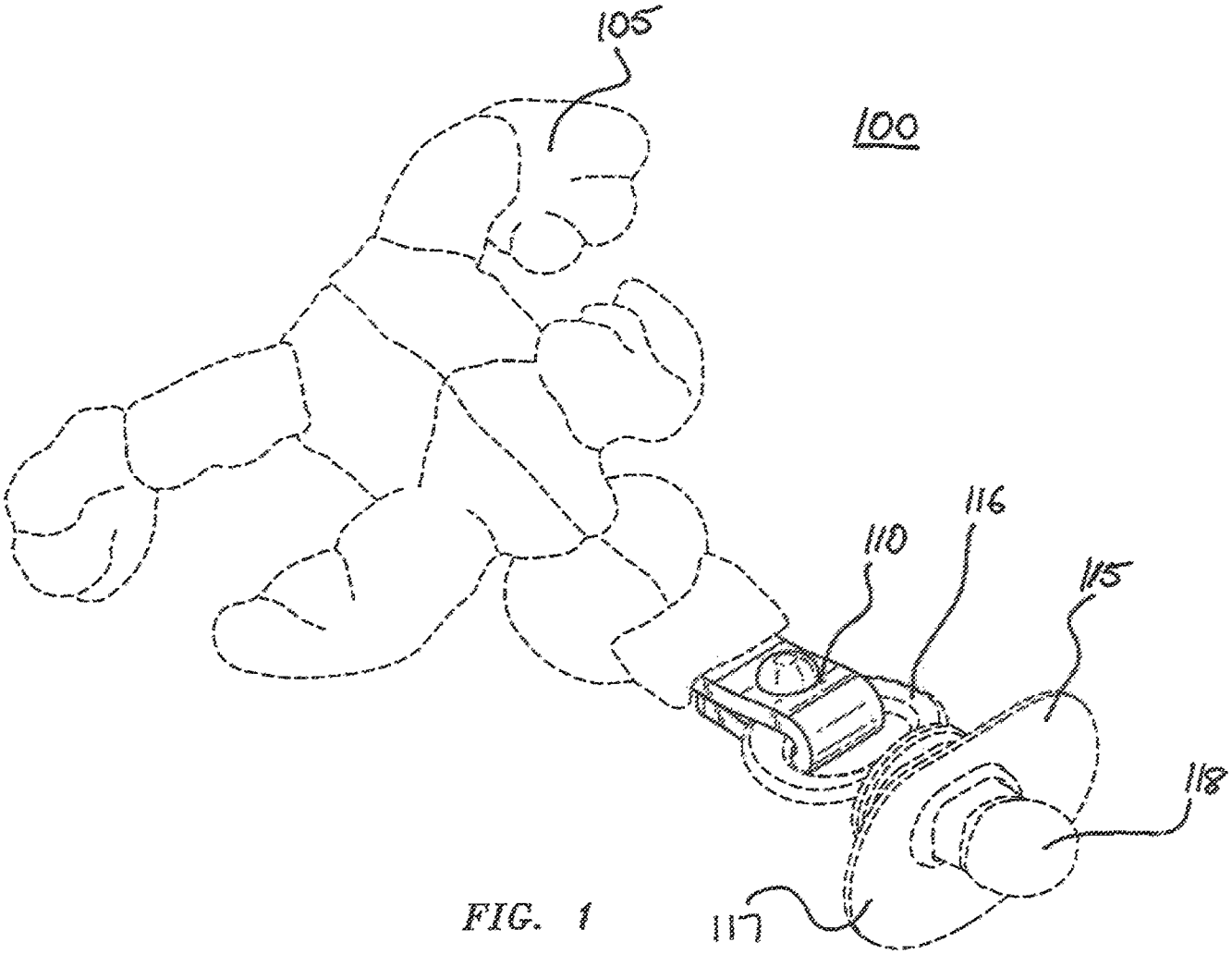
FIG. 1 is a right front perspective view of a combined toy and pacifier assembly including a pacifier attachment device, a pacifier and a toy.
Figure 2:
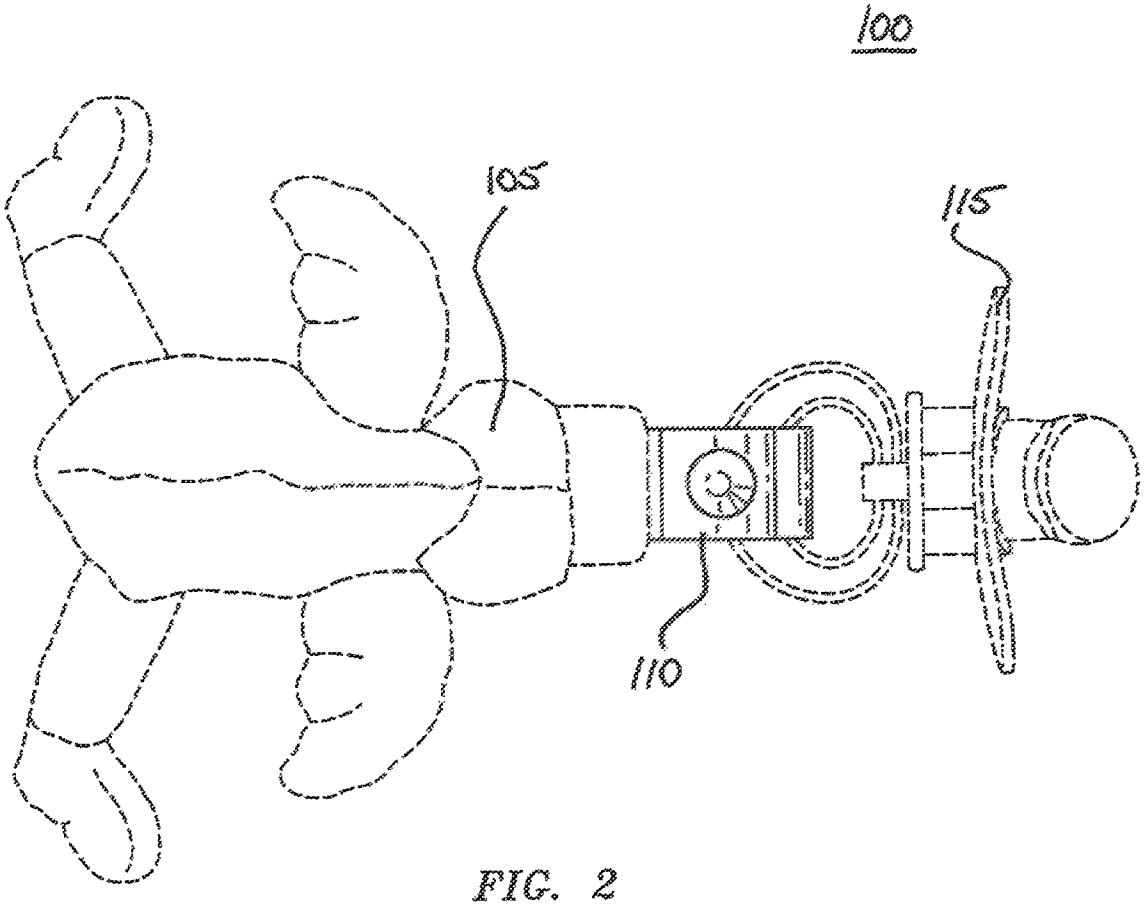
FIG. 2 is a bottom view of the combined toy and pacifier assembly.
Figure 3:
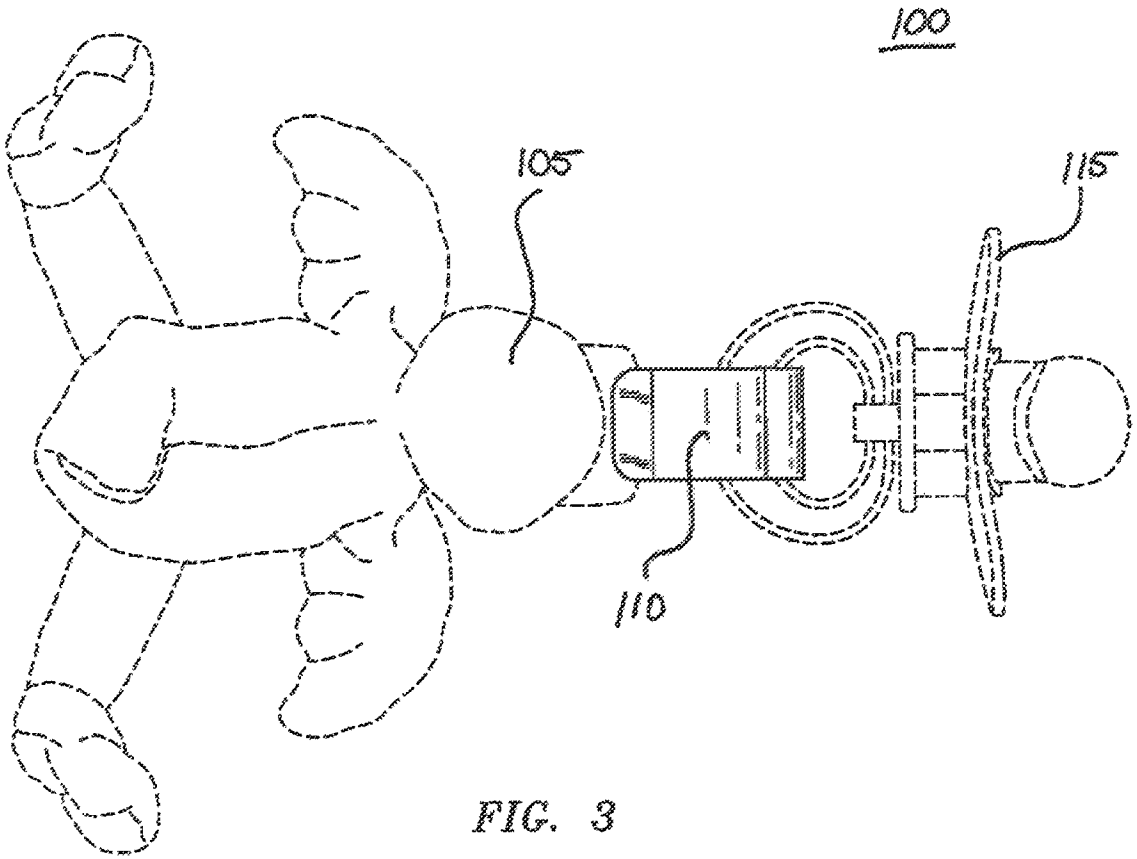
FIG. 3 is a top view of the combined toy and pacifier assembly.
Figure 4:
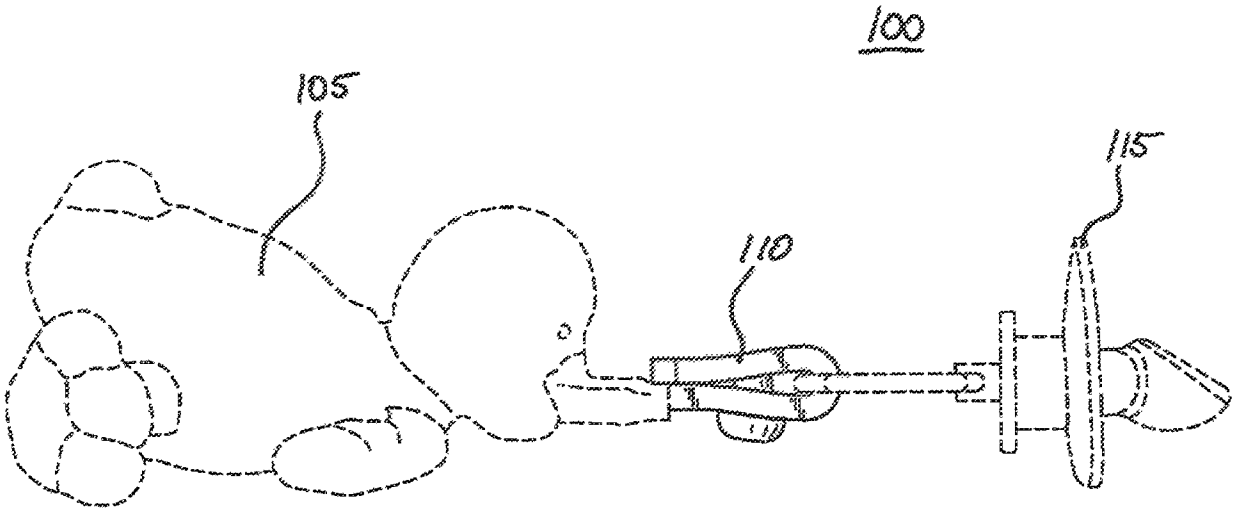
FIG. 4 is a right side view of the combined toy and pacifier assembly.
Figure 5:
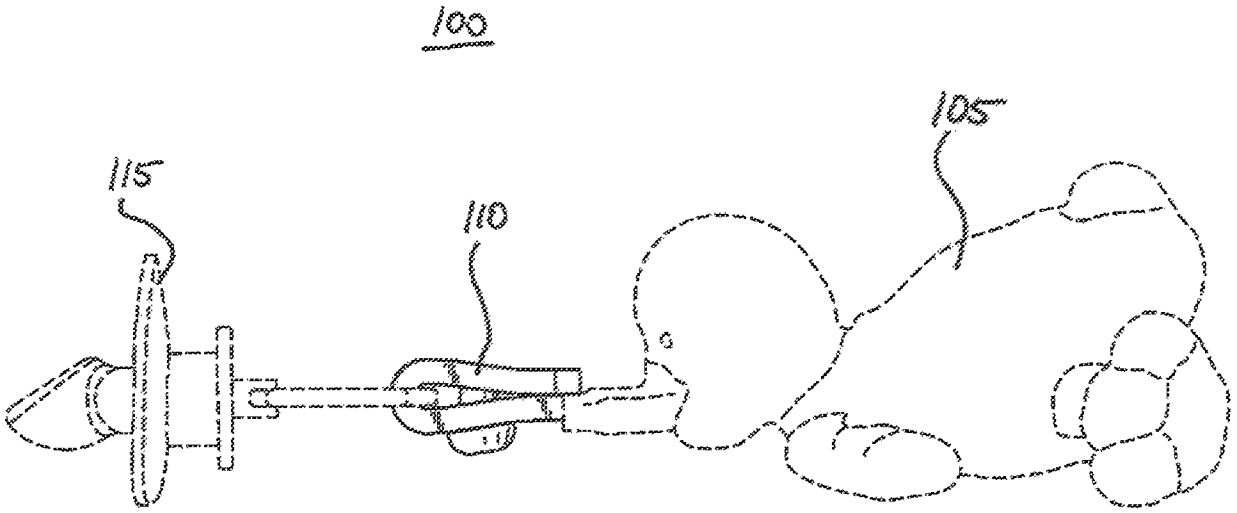
FIG. 5 is left side view of the combined toy and pacifier assembly.
Figure 6:
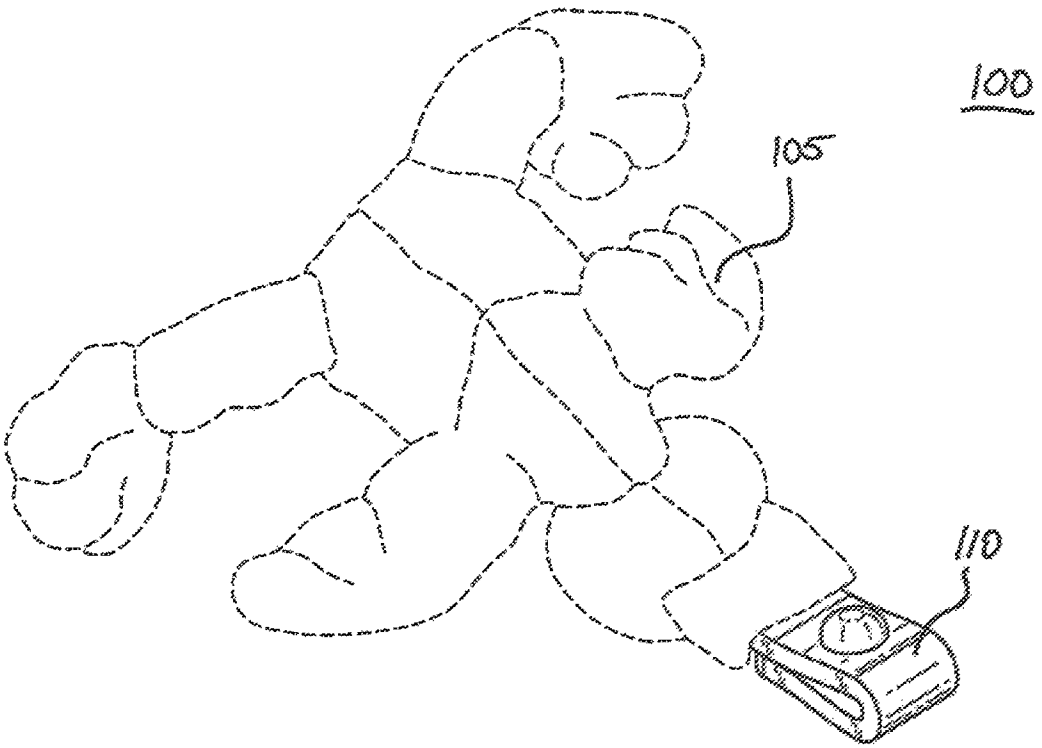
FIG. 6 is right front perspective view of the combined toy and pacifier assembly with the pacifier removed.

The following detailed description of certain embodiments will be made in reference to the accompanying drawings. In the detailed description, explanation about related functions or constructions known in the art are omitted for the sake of clearness in understanding the concept of the invention, to avoid obscuring the invention with unnecessary detail.

FIGS. 1-6 illustrate various s of a combined toy and pacifier assembly 100. The combined toy and pacifier assembly 100 includes a plush toy 105, a pacifier attachment device 110, and a pacifier 115. The toy 103 is exemplary illustrated as a stuffed-animal duck, though it may be any animal, any geometric shape, any three-dimensional shape or any other toy suitable for a young child, particularly for an infant. As further described herein, the combined toy and pacifier assembly 100 is designed to attach the toy universally to any pacifier including a pacifier ring or including any other suitable attachment member or connector, such as a loop or an opening through which the pacifier attachment device 110 may be passed. As shown in FIGS. 1-6, the stuffed-animal toy 105 includes a head, a body and four legs, and the pacifier attachment device 110 is coupled to the head of the stuffed animal toy, and in particular, to a projecting portion of the head of the stuffed animal toy, such as a duck bill.

The assembly 100 of the invention may be sold as the combined toy and pacifier assembly shown in FIGS. 1-6. In some cases, a plush toy assembly including the toy with the pacifier attachment device, and not eluding the pacifier, may be provided so that a user can use any pacifier already owned by the user e plush toy assembly. In yet other cases, the plush toy assembly may be sold together with the pacifier but can also be used with other pacifiers.

As shown in FIGS. 1-6, the pacifier 115 includes a pacifier ring 116, a pacifier base 117 and a pacifier nipple 118. The pacifier base 117 comprises a substantially flat annular ring-shaped member or flange and includes a first surface and a second opposing surface. As discussed above, the pacifier ring 116 comprises a ring-shaped member or any other suitable attachment member that includes a loop or an opening through which the pacifier attachment device 110 may be passed. The pacifier ring 116 is coupled to the first surface of the pacifier base 117 using a suitable coupling mechanism, and the pacifier nipple 118 is coupled to, or extends from, the second, opposing, surface of the pacifier base 117. The pacifier ring 116 may be coupled to the pacifier base 117 so as to allow the pacifier ring to rotate relative to the pacifier base 117 and/or to otherwise move 116 relative to the pacifier base 117 within a certain movement range.

The pacifier 115 to be coupled to the plush toy 105 may be any suitable pacifier used by young children. As further described herein, the pacifier attachment device 110 is securely coupled to the toy 105 and can be releasably coupled to the pacifier 115. When the toy 105 is coupled to the pacifier 115 via the pacifier attachment device, the pacifier 115 can be inserted into a child's mouth and the child can play with, or otherwise be entertained by, the toy 105. In addition, the child can hold the toy so as to prevent losing the pacifier, and due to the larger size of the combined toy and pacifier assembly, the assembly is prevented from falling through the slats of the child's crib or playpen.

Figure 7:
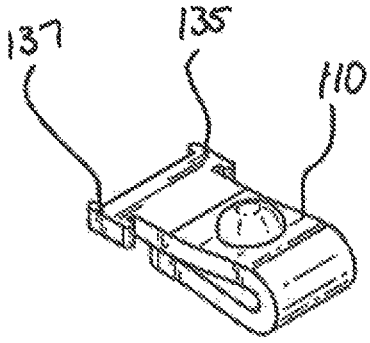
FIG. 7 is a right front perspective view of the pacifier attachment device.
Figure 8:
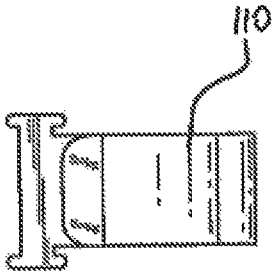
FIG. 8 is a bottom view of the pacifier attachment device.
Figure 9:
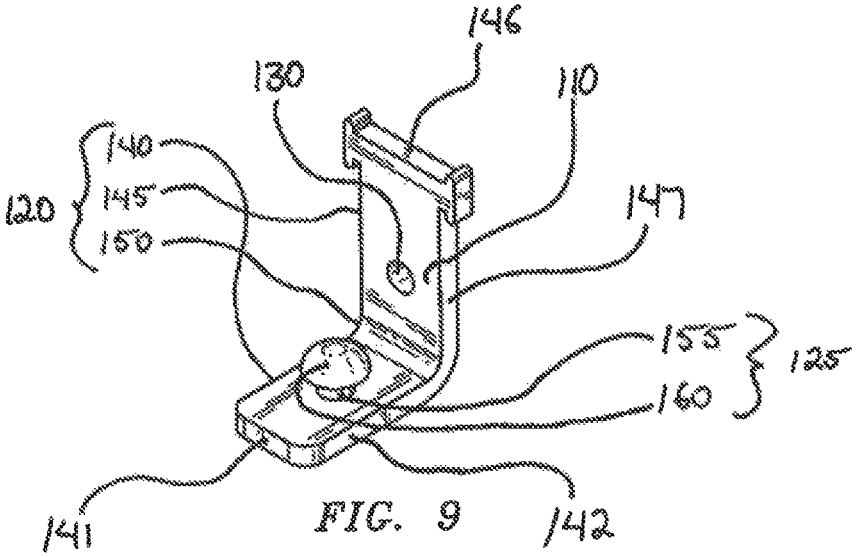
FIG. 9 a left front perspective view of the pacifier attachment device.

FIGS. 7-9 illustrate various views of the pacifier attachment device 110. The pacifier attachment device 110 includes a strap member 120, a post member 125, an opening or a through aperture 130, a first tab member 135 and a second tab member 137. The first and second tab member 135, 137 extend from side edges of the strap member 120 at one end of the strap member 120.

The strap member 120 includes a first strap portion 140 and a second strap portion 145 with a hinge portion 150 disposed therebetween. The strap member 120, and each component of the strap member 120, is constructed from an elastic and flexible material, such as plastic, rubber, silicone, or other suitable material, which is preferably water proof or water resistant. In the illustrative embodiment shown in FIGS. 7-9, the first and second straps 140, 145 are integrally formed with the hinge portion 150 of the strap member 120.

In some embodiments, the coupling mechanism for coupling the first and second straps 140, 145 as well as the first and second tab members 135, 137 are integrally formed with the strap member 120. The coupling mechanism shown in FIGS. 7-9 includes the post 125 and the aperture 130. Natural polymer materials, such as rubber, synthetic polymer materials, such as plastic, silicone, resins, mixtures of such materials or any other suitable flexible elastic, and preferably water proof, materials may be used for forming the integral components of the pacifier attachment device 110. Methods such as injection molding, compression molding or any other suitable techniques may be used to form the pacifier attachment device 110. By forming the pacifier attachment device 110 as a singular integral piece, the present invention avoids use of small parts and pieces that may become detached from the pacifier attachment device and avoids use of adhesives or other coupling materials.

The first strap portion 140 includes a first strap end 141 and first side edges 142. The second strap portion 145 includes a second strap end 146 and second side edges 147. In some embodiments, a width of the first strap portion 140 is substantially equal to a width of the second strap portion 145. As shown in FIG. 8, the length of the first strap portion is smaller than the length 140 of the second strap portion 145. The second strap portion 145 includes the first and second tab members 135, 137 extending from its side edges 147 at the end portion that extends beyond the length of the first strap portion 140. The tab members are described in more detail below.

The hinge portion 150 of the strap member is bendable so as to allow the first and second strap portions to bend relative to one another as shown in FIGS. 7 and 9. Although in the embodiment shown in FIG. 7, the thickness of the hinge portion 150 is substantially the same as the thicknesses of the first and second strap portions 140, 145, in other embodiments, the thickness of the hinge portion 150 may be made smaller than the thicknesses of the first and second strap portions 140, 145 to form a living hinge. In such embodiments, the thickness of the hinge portion 150 may be reduced by forming a recess or a notch in the hinge portion 150, preferably on the same surface of the hinge portion 150 as the surface of the first strap portion 140 from which the post member 125 extends. Also in some embodiments, the width of the hinge portion 150 may be made smaller than the width of the first and second strap portions 140, 145.

As shown in FIG. 9, the post member 125 includes a support portion 155 and a locking end portion 160 extending from the support portion 155. The support portion 150 extends from, and is coupled to, the first strap portion 140, and in some illustrative embodiments, the support portion 155 is integrally formed with the first strap portion 140. In the illustrative embodiment shown in FIG. 9, the support portion 155 has a cylindrical shape. However, in other embodiments, the shape of the support portion 155 is not limited to the cylindrical shape, and other shapes may be used, such as far example a support portion with a square or rectangular cross-section. The support portion 155 may be disposed in a central area of the first strap portion 140 and extends from one of the surfaces of the first strap portion 140. However, in some embodiments, the support portion 155 may be disposed at a position closer to the first strap end 141 or closer to the hinge portion 150. The looking end portion 160 shown in the illustrative embodiment of FIGS. 7 and 9 comprises a dome shape with a rounded top so that the support portion 155 and the locking end portion 160 have an overall mushroom shape. However, in other embodiments, other shapes of the locking end portion 160 may be used, such as a pyramid shape with an angled top surface or other suitable shapes. The locking end portion 160 is integrally formed with the support portion 155.

As shown, the locking end portion 160 has a span or width that is greater than a span or width of the support portion 155 and is greater than the remainder of the post member 125. The span or width of the locking end portion 160 is also greater than a diameter or width of the aperture 130. In some embodiments, the span or width of the support portion 155 is substantially the same or smaller than the diameter or width of the aperture 130.

The aperture 130, which is a through aperture, is disposed in a central area of the second strap portion 145 that aligns with the position of the post member 125 when the hinge portion 150 is in a bent state and first and second strap portions 140, 145 abut one another. As discussed above, the post member 125 may be positioned closer or further away from the hinge portion 150. In such cases, the position of the aperture 130 in the second strap portion 145 is correspondingly shifted so as to align with the post member 125 when the first and second strap portions 140, 145 are moved to abut one another. In such configurations, the post member 125, and specifically, the support portion 155, and the aperture 130 are each disposed on their respective first and second strap portions 140, 145 at substantially equal distances from the hinge portion 150.

Although in the attachment device of FIGS. 7-9, the post member 125 extends from the first strap portion 140 and the aperture 130 passes through the second strap portion 145, in other embodiments, the post member 125 may be provided to extend from the second strap portion 145 and the aperture 130 may pass through the first strap portion 140. In either configuration, when the strap member 120 is bent about the hinge portion 150 and a length of the first strap portion 140 is disposed parallel to a length of the second strap portion 145, the locking end portion 160 is aligned with the through aperture 130 and is positioned to be inserted into the aperture 130.

The locking end portion 160 is constructed from a material that is sufficiently flexible and elastic so as to squeeze through the aperture 130, but also sufficiently rigid so that the second strap portion 145 is secured between the locking end portion 160 and the first strap portion 140 in a locked position. In the embodiments in which the post member 125 is provided on the second strap portion 145 and the aperture is provided in the first strap portion 140, the first strap portion 140 is releasably secured between the locking end portion and the second strap portion 145.

As a result, the locking, end portion 160 releasably locks the second strap portion relative to the first strap portion. The locking end portion 160 therefore removably holds the first strap portion 140 and the second strap portion 145 together, so as to enable releasable locking of the strap member 120 around the pacifier ring 116. This construction allows releasing of the locking between the locking end portion 160 and the aperture by squeezing the flexible and elastic locking end portion 160 and passing it through the aperture 130 so as to release the post member 125 from the aperture 130. This allows the strap member 120 to be disengaged from the pacifier ring.

The above-described construction of the pacifier attachment device allows for attachment and detachment of the pacifier to and from the toy so as to allow washing/cleaning of either the pacifier or the toy separately, and to allow for replacement of the pacifier with a new one to be attached to the toy.

In the attachment device of FIGS. 7-9, the first tab member 135 and the second tab member 137 extend in opposite directions from the second side edges 147 adjacent to the second strap end 146 of the second strap portion 145. In other embodiments, the first and second tab members 135, 137 may instead extend from the side edges 142 of the first strap portion 140 near the strap end 141. In the illustrative embodiment shown in FIGS. 7-9, each of the first and second tab members 135, 137 has a T-shape, each of the tab members comprising a central projection extending from the respective side edge 147 of the second strap, and side projections extending from opposing side edges adjacent an outer edge of the central projection.

As discussed above, when the first strap portion 140 and the second strap portion 145 are coupled together, the second strap end 146 extends beyond the first strap end 141 and the tab members 135, 137 extend from the second strap end 146 that extends beyond the first strap end. When the pacifier attachment device 110 is secured to the toy, the tab members 135, 137 are disposed inside the toy's outer envelope and assist in retaining the pacifier attachment device 110 attached to the toy 105. The T-shape of the tab members in the embodiment shown further assists in securely retaining the attachment between the pacifier attachment device 110 and the toy 105. In other embodiments, the shape of the first and second tab members 135, 137 may be any other suitable shape that allows for the first tab member 135 and the second tab member 137 to secure the strap member 120 to the toy 105.

In order to secure the strap member 120 to the toy 105, the strap end with the tab members, i.e., the second strap end 146 in FIGS. 7-9, is inserted between two pieces of open fabric in the toy 105. For example, as illustrated in FIGS. 1-6, the second strap end 146 is inserted between two pieces of fabric forming the mouth or duck bill of the toy 105. However, in other embodiments, the second strap end 146 may be inserted into any location of the toy 105 that is suitable for securing the strap member 120 to the toy 105. The pieces of open fabric are then stitched together around the first tab member 135 and the second tab member 137, thereby securing the strap member 120 to the toy 105. In some embodiments, the stitching does not pass through the strap member 120, while in other embodiments, additional stitching may be provided to stitch the strap member to the outer envelope of the toy 105. In other embodiments, adhesive bonding, stitching or other means of securing the toy to the strap member 120 or a combination of these methods may be used in addition to, or instead of, the method described above.

Moreover, while in the illustrative embodiment of FIGS. 7-9, the first and second tab members are provided on the second strap end 126, in other embodiments, the tab members may be provided on the first strap end 141 so that the first strap portion 140 is attached to the toy.

While embodiments of the invention have been shown and described with reference to certain embodiments thereof, it will be understood by those skilled in the art that various changes in form and details may be made therein without departing from the spirit and scope of the invention as defined by the appended claims and equivalents thereof.

What is claimed is:

1. A pacifier attachment device for releasably attaching a pacifier to a plush toy, the pacifier attachment device comprising:

an integrally-formed substrate formed as a single piece from a flexible and elastic polymer material, wherein the integrally-formed substrate includes a strap having first and second opposing surfaces and having a first strap portion and a second strap portion, respective first ends of the first strap portion and the second strap portion being directly coupled to one another so as to form a bendable hinge, and a coupling mechanism for releasably coupling the first strap portion with the second strap portion, said coupling mechanism being integrally formed as a single piece with the strap from the flexible and elastic polymer material, wherein the coupling mechanism includes a locking projection protruding transversely from the first surface of the first strap portion and a through opening extending between the first and second opposing surfaces of the second strap portion, the locking projection being configured to engage with the through opening and the locking projection including a locking end portion having a greater span than a diameter of the through opening in width and length directions of the locking end portion and the locking end portion having a decreasing thickness from a center to an outer periphery of the locking end portion;

wherein the locking projection is positioned away from a free end of the first strap portion in a direction of the bendable hinge so that the locking projection is one of (a) centrally positioned between the free end of the first strap portion and a midpoint between the locking projection and the through opening, and (b) positioned closer to the midpoint between the locking projection and the through opening than to the free end of the first strap portion, the bendable hinge including the midpoint and the locking projection and the through opening being equidistant from the bendable hinge, wherein the through opening is positioned away from a free end of the second strap portion in a direction of the bendable hinge so that the through opening is one of (c) centrally positioned between the free end of the second strap portion and the midpoint, and (d) positioned closer to the midpoint than to the free end of the second strap portion, wherein the free end of one of the first strap portion and the second strap portion is configured to be securely and non-releasably attached to the plush toy and the free end of the other one of the first strap portion and the second strap portion is configured to pass through an opening in the pacifier and to releasably attach the pacifier to the plush toy by releasably coupling the first and second strap portions using the coupling mechanism, wherein when the first and second strap portions are coupled with one another, a majority portion of each of the first and second strap portions overlap with one another, wherein the entire pacifier attachment device is integrally formed as a single piece, and wherein one of the first and second strap portions has a greater length than the other of the first and second strap portions, and the one of the first and second strap portions includes first and second retaining tabs extending from its opposing side edges and provided adjacent a free end of the one of the first and second strap portions, wherein the first and second retaining tabs are adapted to be inserted into the plush toy and to be retained within the plush toy when the pacifier attachment device is securely coupled with the plush toy, wherein each of the first and second retaining tabs has a T shape.

2. The pacifier attachment device in accordance with claim 1, wherein the bendable hinge is a living hinge and wherein the bendable hinge has a first thickness and the first and second strap portions have a second thickness greater than the first thickness.

3. The pacifier attachment device in accordance with claim 1, wherein:

the locking projection comprises a post member including the locking end portion, wherein the locking end portion has a greater span than the remainder of the post member, and wherein the post member is adapted to be inserted into the through opening so as to releasably retain the second strap portion between the first strap portion and the locking end portion of the post member.

4. The pacifier attachment device in according with claim 3, wherein the locking end portion is dome shaped.

5. A combined toy and pacifier assembly comprising:

a plush toy;

a pacifier comprising a connector with a through aperture, a pacifier base and a pacifier nipple, wherein the connector is coupled to a first surface of the pacifier base and the pacifier nipple extends from a second surface of the pacifier base opposing the first surface; and a pacifier attachment device in accordance with claim 3 securely coupled with the plush toy, wherein the plush toy is releasably coupled with the pacifier using the pacifier attachment device by passing the strap of the pacifier attachment device through the aperture in the connector of the pacifier and inserting the post member into the through opening of the pacifier attachment device so as to releasably retain the second strap portion between the first strap portion and the locking end portion of the post member.

6. The combined toy and pacifier assembly in accordance with claim 5, wherein the connector of the pacifier comprises a pacifier ring.

7. The pacifier attachment device in accordance with claim 1, wherein the flexible and elastic polymer material includes one or more of silicone, plastic, resin and rubber.

8. A toy assembly adapted to be releasably coupled to a pacifier, said toy assembly including:

a three-dimensional plush toy; and the pacifier attachment device in accordance with claim 1 securely coupled with the plush toy.

9. The toy assembly in accordance with claim 8, wherein the plush toy has a three-dimensional animal shape including at least a body and a head extending from the body in a longitudinal direction, and wherein the pacifier attachment device is directly and securely coupled to the head of the plush toy and extends from the head of the plush toy substantially in the longitudinal direction.

10. A combined toy and pacifier assembly comprising:

a plush toy;

a pacifier comprising a connector with a through aperture, a pacifier base and a pacifier nipple, wherein the connector is coupled to a first surface of the pacifier base and the pacifier nipple extends from a second surface of the pacifier base opposing the first surface; and a pacifier attachment device in accordance with claim 1 securely coupled with the plush toy, wherein the plush toy is releasably coupled with the pacifier using the pacifier attachment device by passing the strap of the pacifier attachment device through the aperture in the connector of the pacifier and releasably coupling the first portion of the strap with the second portion of the strap.

11. The combined toy and pacifier assembly in accordance with claim 10, wherein the connector of the pacifier comprises a pacifier ring.

12. The pacifier attachment device in accordance with claim 1, wherein the pacifier attachment device is configured to allow rotational movement of the pacifier relative to the pacifier attachment device in at least two planes without releasing the coupling between the first and second strap portions.

13. The pacifier attachment device in accordance with claim 1, wherein the first strap portion has a first length between the free end of the first strap portion and the midpoint and the second strap portion has a second length between the free end of the second strap portion and the midpoint and when the first and second strap portions are coupled with one another, a majority portion of each of the first length and the second length overlap with one another.

14. The pacifier attachment device in accordance with claim 1, wherein the strap has a width and a thickness such that when a pacifier is attached using the pacifier attachment device, the strap limits rotation of the pacifier along a longitudinal axis of the strap.

15. A pacifier attachment device for releasably attaching a pacifier to a plush toy, the pacifier attachment device comprising:

an integrally-formed substrate formed as a single piece from a flexible and elastic polymer material, wherein the integrally-formed substrate includes a strap having a first strap portion and a second strap portion, and a coupling mechanism for releasably coupling the first strap portion with the second strap portion, said coupling mechanism being integrally formed as a single piece with the strap from the flexible and elastic polymer material, and wherein an end of one of the first strap portion and the second strap portion is configured to be securely and non-releasably attached to the plush toy and includes first and second retaining tabs extending from its opposing side edges, and the other one of the first strap portion and the second strap portion is configured to pass through an opening in the pacifier and to releasably attach the pacifier to the plush toy by releasably coupling the first and second strap portions using the coupling mechanism, wherein the coupling mechanism includes a first coupling portion provided on the first strap portion and a second coupling portion provided on the second strap portion and configured to engage with the first coupling portion, wherein the first coupling portion is positioned away from a free end of the first strap portion in a direction of a hinge formed between the first and second strap portions so that the first coupling portion is one of (a) centrally positioned between the free end of the first strap portion and a midpoint between the first and second coupling portions, and (b) positioned closer to the midpoint between the first and second coupling portions than to the free end of the first strap portion, and the midpoint between the first and second coupling portions is located on the hinge formed between the first and second strap portions, wherein the second coupling portion is positioned away from a free end of the second strap portion in a direction of the hinge so that the second coupling portion is one of (c) centrally positioned between the free end of the second strap portion and the midpoint, and (d) positioned closer to the midpoint than to the free end of the second strap portion, wherein first and second coupling portions are disposed on the respective first and second strap portions at substantially equal distances from the hinge, wherein when the first and second strap portions are coupled with one another, a majority portion of each of the first and second strap portions overlap with one another, and wherein the first and second retaining tabs are configured to be inserted into the plush toy and to be retained within the plush toy when the pacifier attachment device is securely coupled with the plush toy, and each of the first and second retaining tabs includes opposing tab side edges and at least one transverse protrusion extending transversely from at least one of the tab side edges configured to strengthen secure coupling between the pacifier attachment device and the plush toy.

16. The pacifier attachment device in accordance with claim 15, wherein one of the first and second strap portions has a greater length than the other of the first and second strap portions, the first and second retaining tabs are provided adjacent a free end of the one of the first and second strap portions.

17. The pacifier attachment device in accordance with claim 15, wherein the first strap portion is greater in length than the second strap portion, and wherein the first coupling portion is positioned closer to the midpoint between the first and second coupling portions than the free end of the first strap portion.

18. The pacifier attachment device in accordance with claim 15, wherein each of the first and second retaining tabs has a T shape.

19. A toy assembly configured to be releasably coupled to a pacifier, said toy assembly including:

a three-dimensional plush toy; and a pacifier attachment device for releasably attaching the pacifier to the toy, the pacifier attachment device comprising:

an integrally-formed substrate formed as a single piece from a flexible and elastic polymer material, wherein the integrally formed substrate includes a strap having a first strap portion and a second strap portion, and a coupling mechanism for releasably coupling the first strap portion with the second strap portion, said coupling mechanism being integrally formed as a single piece with the strap from the flexible and elastic polymer material, wherein the pacifier attachment device is securely and non-releasably coupled with the plush toy;

wherein one of the first and second strap portions includes first and second retaining tabs extending from its opposing side edges, and the first and second retaining tabs are inserted into the plush toy and retained within the plush toy such that the pacifier attachment device is securely and non-releasably coupled with the plush toy; and wherein each of the first and second retaining tabs includes opposing tab side edges and at least one transverse protrusion extending transversely from at least one of the tab side edges configured to strengthen secure coupling between the pacifier attachment device and the plush toy.

20. The toy assembly in accordance with claim 19, wherein the one of the first and second strap portions has a greater length than the other of the first and second strap portions and the first and second retaining tabs are provided adjacent a free end of the one of the first and second strap portions.

21. The toy assembly in accordance with claim 19, wherein each of the first and second retaining tabs has a T shape.

22. The toy assembly in accordance with claim 19, wherein the first and second retaining tabs assist in securely retaining a primary attachment of the strap to the toy during normal use of the toy assembly.

23. The toy assembly in accordance with claim 22, wherein the pacifier attachment device is securely coupled to a fabric envelope of the plush toy by securely coupling a first portion of the fabric envelope to a second portion of the fabric envelope around peripheries of the first and second tab members.

24. The toy assembly in accordance with claim 19, wherein the coupling mechanism comprises:

a post member extending from a surface of the first strap portion, and a through opening provided in the second strap portion, wherein the post member includes a locking end portion having a greater span than the remainder of the post member and a greater span than a diameter of the through opening, and wherein the post member is adapted to be inserted into the through opening so as to releasably retain the second strap portion between the first strap portion and the locking end portion of the post member.

* * * * *